US005569885A

United States Patent [19]

Petit, Jr. et al.

[11] Patent Number: 5,569,885

[45] Date of Patent: Oct. 29, 1996

[54] INSULATED LINK

[75] Inventors: Theodore E. Petit, Jr., Warwick, R.I.; Leonard L. Ivel, Leicester, Mass.

[73] Assignee: GHM Industries, Worcester, Mass.

[21] Appl. No.: 322,914

[22] Filed: Oct. 12, 1994

[51] Int. Cl.[6] ..... H01B 17/00

[52] U.S. Cl. ..... 174/178; 174/183; 174/137 R

[58] Field of Search ..... 174/183, 137 R, 174/180, 141 R, 150, 148, 188, 182, 178, 195

[56] References Cited

U.S. PATENT DOCUMENTS 1,206,159 11/1916 Steinberger ..... 174/183

2,897,257 7/1959 Ingram et al. ..... 174/183

FOREIGN PATENT DOCUMENTS 975635 3/1962 Germany ..... 174/183

*Primary Examiner*—Kristine L. Kincaid

*Assistant Examiner*—Paramita Ghosh

*Attorney, Agent, or Firm*—Jon L. Roberts; Roberts & Brownell

[57] ABSTRACT

An insulated link using new castable insulating materials and interim molds. A strong, insulating cast dielectric is assembled with metal plates to form a core assembly. A low viscosity bonding compound introduced into the core prior to casting an outer dielectric jacket eliminates the formation of air pockets. This construction provides a link that can support heavy loads and that has strong dielectric properties. The simplified method of construction of the link increases manufacturing yields, as well as the durability, ultraviolet resistance, and electrical resistance of the link.

3 Claims, 3 Drawing Sheets

INSULATED LINK

FIELD OF THE INVENTION

The present invention relates generally to insulating links used under loading conditions and to a method by which the links are made. More specifically, the present invention relates to links or insulated coupling devices used in heavy hoisting equipment to couple the hoisting hook to the hoist line in such a manner as to support the load and to electrically insulate the load and the hook from the hoist line and boom.

BACKGROUND OF THE INVENTION

The leading cause of electrical injury in the workplace is accidental contact between crane booms and overhead power lines while a worker is touching the crane load. In response to this hazard, links have been developed which electrically isolate the load from the crane cable. These insulated links prevent electrical current flow from the boom through a worker guiding the crane load on the ground. Normally, such insulated links include a dielectric material that can support a heavy load and is also resistant to breakdown even when a large electrical potential is applied across it.

One of the problems associated with the present manufacture of insulated link devices is the unreliable vulcanizing process used in manufacturing the links. This process results in low manufacturing yields due to frequent cracking of the dielectric during the curing phase. This cracking is often caused by the high thermal mass of the metal parts of the link that are embedded in the dielectric. The process is also expensive because when the defective dielectric is revealed during electrical testing, the entire link unit must be scrapped.

For example, U.S. Pat. No. 2,897,257 to Ingram et al. discloses a conventionally constructed insulated link. The link includes two pairs of steel plates separated by a dielectric made of rubber or a rubber-like material. The dielectric is formed integrally of a single homogeneous mass of the insulating material cast or molded upon and around the assembled metal structure. A mold and fixture used in making the link are also disclosed, as is the process for constructing the link. The link has acceptable load-handling and dielectric properties, but the vulcanizing process used to make the link is time-consuming and labor intensive, and is therefore expensive and results in low yields.

A simpler, less expensive method of manufacturing such a link would be to separate the metal plates of the assembly from each other by a castable insulator made of a high strength, highly dielectric material and then molding a dielectric jacket around this core to form an outer casing. Those of ordinary skill in the art believe that such a construction could not avoid the formation of internal air pockets, resulting in the possibility of breakdown of the insulation in the presence of a high voltage across the link. A link employing such construction and avoiding the formation of such air pockets or shrinkage cracks would provide a strong, highly dielectric link that would be easier and less expensive to manufacture than conventional links.

SUMMARY OF THE INVENTION

It is therefore an object of the present invention to provide an insulated link that includes a core having a high strength cast dielectric and a molded dielectric casing.

It is a further object of the present invention to provide such a core that does not develop internal air pockets that may impair the dielectric capabilities of the link.

It is another object of the present invention to provide an insulated link in which the core of the unit has a reduced thermal mass, thereby eliminating thermally induced stressing and cracking associated with curing of the insulating material being cast.

It is an additional object of the present invention to provide an insulated link in which only the core of the unit is initially cast, thus losing only a portion of the product in the event of an electrical test failure, reducing the economic impact of yield fallout.

It is also an object of the invention to provide an insulated link having a rigid mounting arrangement to ensure that the inter-plate gap is consistent and of sufficient dimensions for full dielectric strength.

It is yet a further object of the present invention to provide an insulated link that uses metal plates having a minimum, rounded surface area, reducing the possibility of air pocket formation and cracking of the dielectric during curing, and enhancing the electrical performance of the link.

These and other objects and advantages of the present invention will be apparent to those of ordinary skill in the art after inspection of the following detailed description considered with the accompanying drawings, and the appended claims.

The present invention uses new castable insulating materials and interim molds in constructing the insulated link. A strong, insulating cast dielectric is assembled with metal plates to form a core assembly. The metal plates are designed for minimum surface area and reduced thermal mass, and have rounded edges to reduce current concentration when a voltage is applied across the link. A low viscosity bonding compound introduced into the core prior to casting an outer dielectric jacket eliminates the formation of air pockets. This construction provides a link that can support heavy loads and that has strong dielectric properties. The simplified method of construction of the link increases manufacturing yields, as well as the durability, ultraviolet resistance, and electrical resistance of the link.

DETAILED DESCRIPTION OF THE INVENTION

Figure 1:
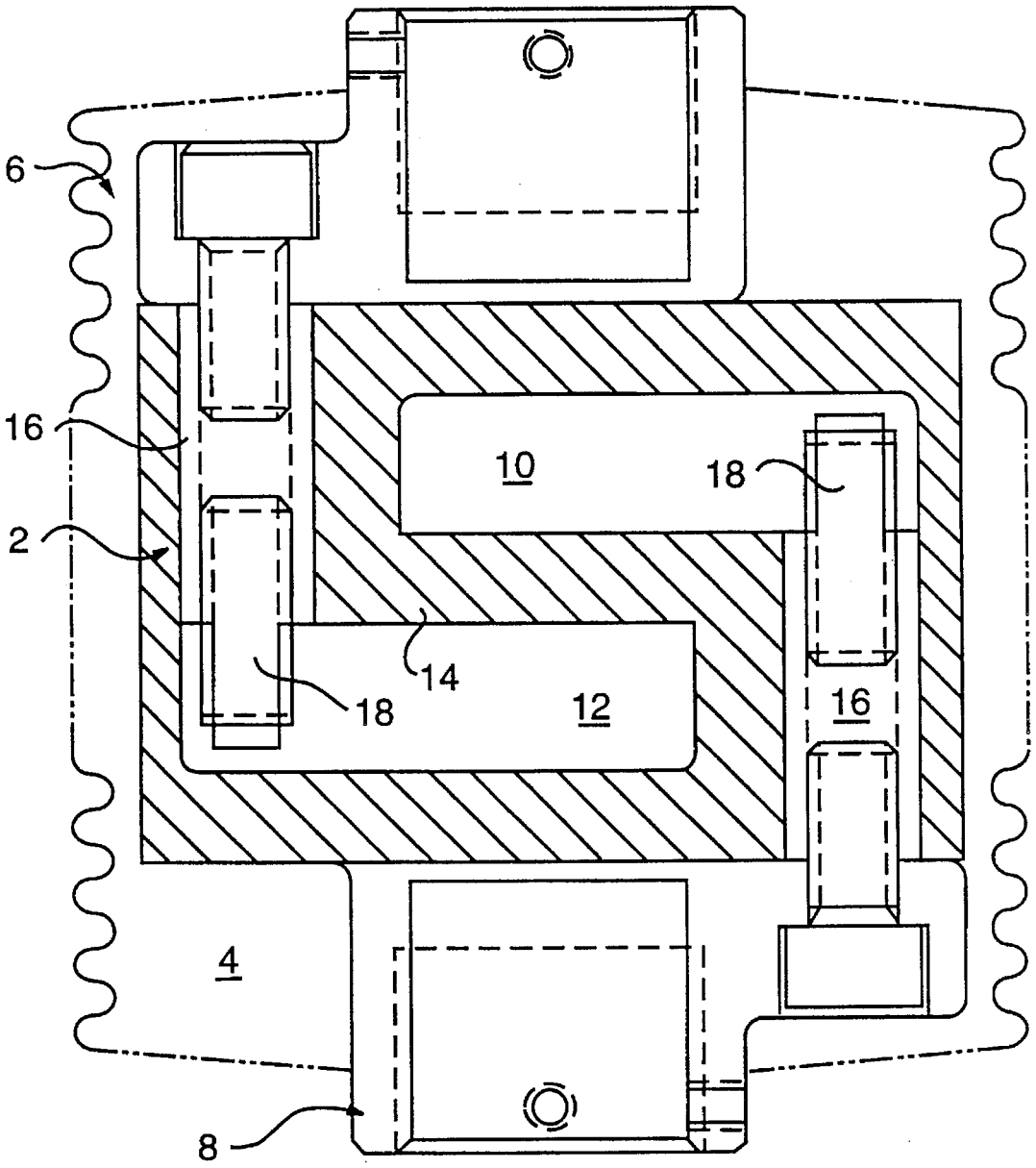
FIG. 1 is a longitudinal sectional view on an enlarged scale of the insulating link and the insulating core.

Referring again to the drawings, attention is first directed to FIG. 1 in which an insulating core 2 is shown encapsulated within the insulating coupling by the outer jacket 4 and mechanically fastened to end plates 6, 8. These end plates 6, 8 function as terminal connections to a swivel, hook, clevis, or other connector or attachment means.

The insulating core 2, according to a preferred embodiment of the present invention, comprises two spaced steel plates 10, 12 separated from each other by a poured dielectric material 14, which upon cure functions as both a mechanical and electrical insulating structure; a plurality of spacers 16, preferably made of metal, fixed to the steel plates 10, 12 by means of allen head bolts 18 or other fasteners; and a bonding compound for the spacers and bolts to eliminate the formation of air pockets during the cure phase of the dielectric material 14. The insulation of the insulating core 2 is made possible by the profile of the center plates, which are designed so as to allow the introduction of a low viscosity material which cures to a durometer and dielectric strength necessary to provide the characteristics desired. The insulating core 2 is then mechanically and electrically tested to ensure that product specifications are met.

Successful testing of the insulating core 2 allows further processing by the attachment of end plates 6, 8, introduction of the sub-assembly into a finish mold and casting the outer jacket 4 using the same material as used in the insulating core 2. Chemically pre-treating the insulating core 2 results in a nearly homogenous structure. The asymmetrical alignment of the opposing end plates 6, 8 eliminates the possible formation of a current path even if the dielectric structure interface between the insulating core 2 and outer jacket 4 is impaired.

Figure 2:
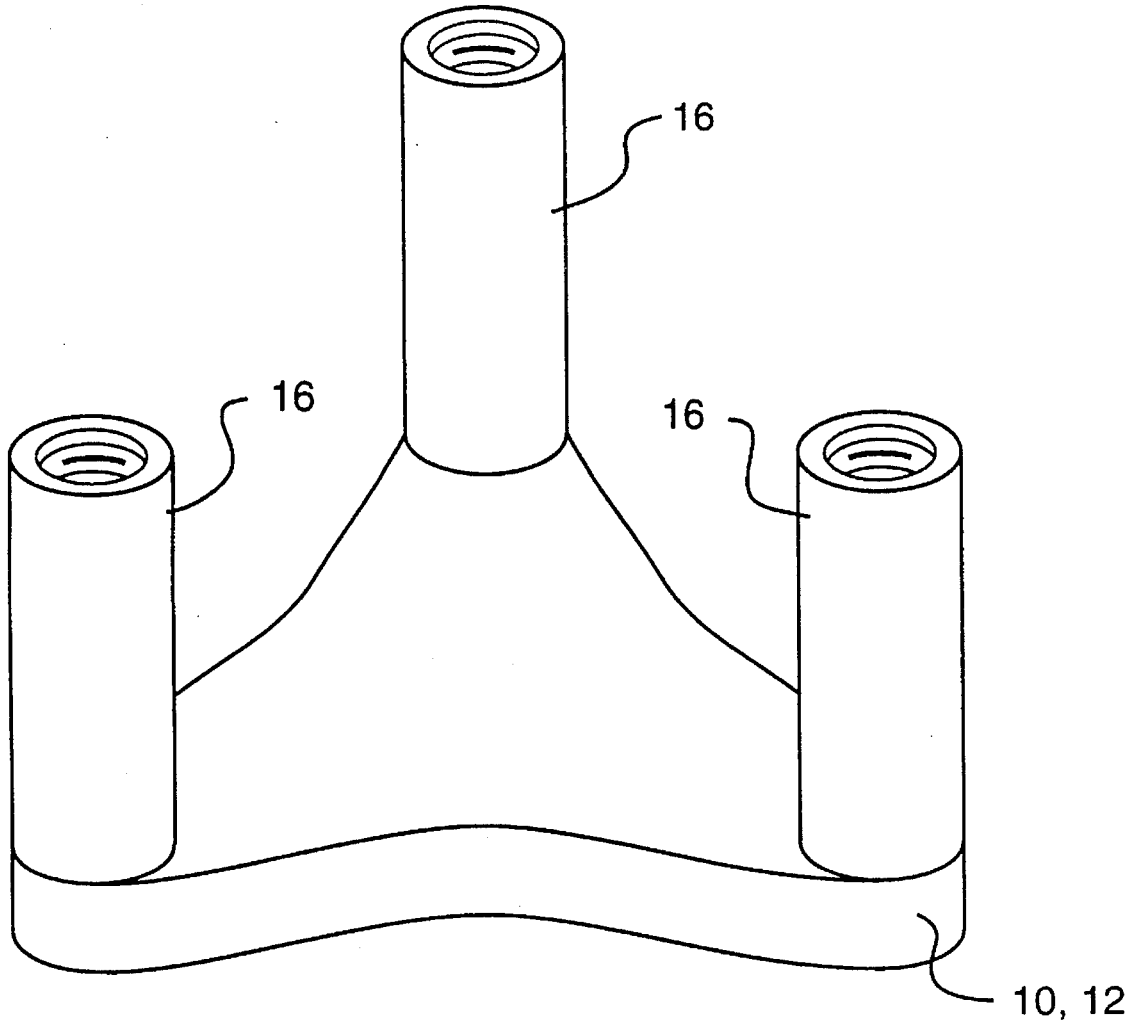
FIG. 2 is an isometric view of one half of the tripod interposing plate so designed as to mitigate air pocket formation which results in electrical failure of the unit.

Referring to FIG. 2, a steel plate 10, 12 is described. As shown, the steel plate 10, 12 is formed in a substantially triangular shape. The corners of the steel plate 10, 12 are preferably rounded, and the sides of the triangular shape preferably bow slightly toward the center of the steel plate 10, 12. The steel plate 10, 12 is shown with the spacers 16 in place, forming a tripod interposing plate.

As described previously, the insulated link includes two of these tripod interposing plates. In the assembled insulated link, the plates are oriented such that the tripods are inverted with respect to each other and the steel plates 10, 12 are parallel to each other. The spacers 16 of each tripod are located opposite the centers of the sides of the opposite triangularly-shaped steel plate 10, 12.

Figure 3:
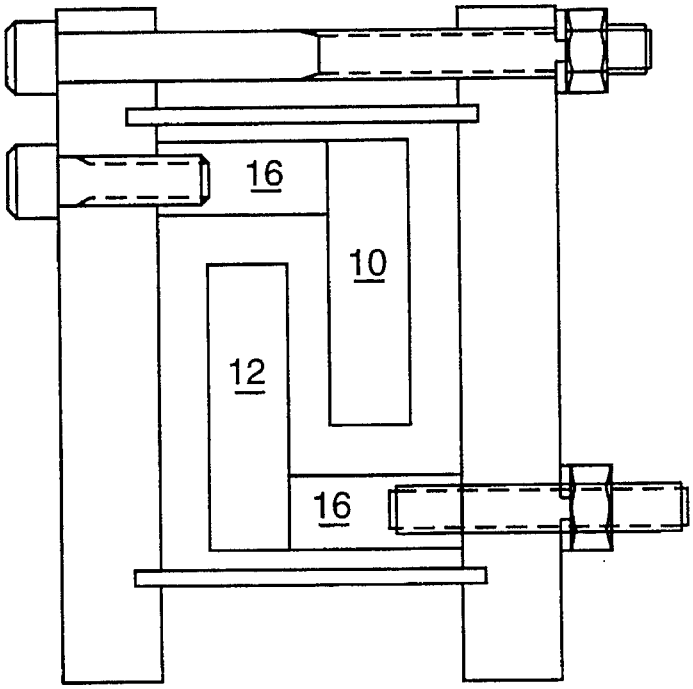
FIG. 3 is a longitudinal sectional view of the mold used in the making of the insulating core and illustrates the positioning and centering of the core parts in the mold preparatory to the casting of the insulating material.
Figure 4:
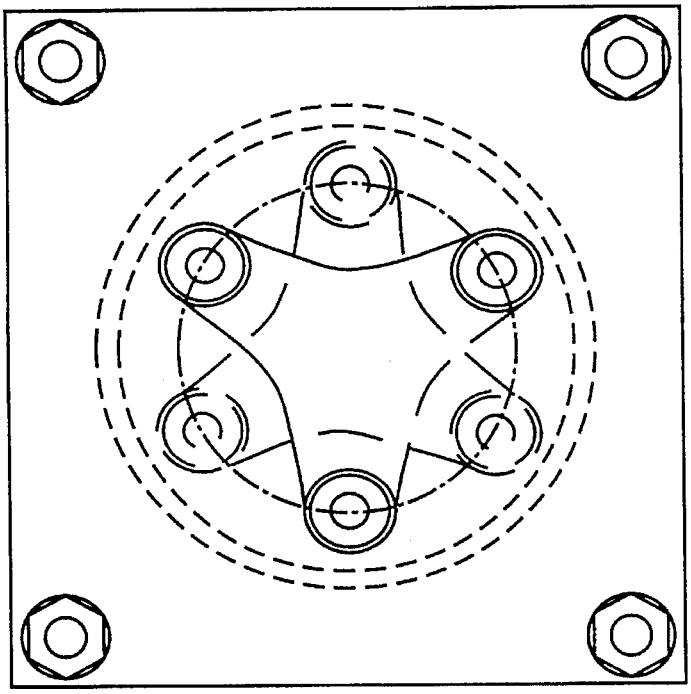
FIG. 4 is a transverse sectional view of the insulating core mold.

While the tripod interposing plates are in this position, they are placed in a mold, as shown in FIG. 3, in preparation for casting the core dielectric. FIG. 4 shows a transverse sectional view of the insulating core mold. The rigid mounting arrangement of the mold ensures that the inter-plate spacing is consistent and of sufficient dimensions for full dielectric strength.

The tripod shape of the plate assembly eliminates much surface area compared to conventional square-shaped, four-legged plates. This reduction in surface area is accompanied by a reduction in thermal mass of the steel, which enables the core dielectric to cure with less likelihood of cracking and a smaller possibility of air pocket formation.

After the core dielectric has been cured, the resulting insulating core 2 is then electrically tested. If the electrical test fails, only this core is discarded. Because the end plates 6, 8 and outer jacket 4 are not fixed to the assembly before electrical testing, these parts are not discarded with a failed unit, resulting in substantial savings over the course of a manufacturing cycle.

The insulating material used as the dielectric can be any strong castable material, such as polyurethane or epoxy. Such material surpasses natural rubber in durability and electrical resistance. The material used should have a hardness of greater than durometer 60 and a dielectric strength of greater than 200 volts per mil. A link constructed using such a material have a load capacity in excess of 60 tons, and resist dielectric breakdown under application of voltages of up to 100,000 volts AC.

Preferred and alternate embodiments of the present invention have now been described in detail. It is to be noted, however, that this description of these specific embodiments is merely illustrative of the principles underlying the inventive concept. It is therefore contemplated that various modifications of the disclosed embodiments will, without departing from the spirit and scope of the invention, be apparent to persons of ordinary skill in the art.

What is claimed is:

1. An insulated link, comprising:

a) an insulating core;

b) a first end plate having a bottom end and a top end, the bottom end attached to the insulating core;

c) a second end plate having a bottom end and a top end, the bottom end attached to the insulating core, the second end plate opposed and in asymmetrical alignment to the first end plate; and d) a removable outer jacket encapsulating the insulating core, at least a portion of the first end plate, and at least a portion of the second end plate, the removable outer jacket comprising a molded dielectric casing, wherein the removable outer jacket encapsulates the insulating core, at least a portion of the first end plate, and at least a portion of the second end plate.

2. The insulated link of claim 1, wherein the insulating core comprises:

a) a first metal plate having a substantially triangular shape;

b) a first plurality of spacers, each of said first plurality of spacers having a proximal end and a distal end, and each of said first plurality of spacers being mounted by a plurality of fasteners at the proximal end to the corners of the substantially triangular shaped first metal plate, the first plurality of spacers establishing a fixed inter-plate spacing between the first metal plate and a second metal plate;

c) the second metal plate having a substantially triangular shape;

d) a second plurality of spacers, each of said second plurality of spacers having a proximal end and a distal end, and each of said second plurality of spacers being mounted by a plurality of fasteners at the proximal end to the corners of the substantially triangular shaped second metal plate, the second plurality of spacers establishing a fixed inter-plate spacing between the first metal plate and the second metal plate; and f) a molded cast dielectric material encapsulating the first metal plate, the second metal plate, all but the distal ends of the first plurality of spacers, and all but the distal ends of the second plurality of spacers and establishing a fixed inter-plate spacing between the first metal plate and the second metal plate and further facilitating formation of the removable outer jacket onto the molded cast dielectric material; and e) the first metal plate oriented such that it is parallel to the second metal plate at a fixed inter-plate spacing with the first plurality of spacers facing the second metal plate and the second plurality of spacers facing the first metal plate.

3. The insulated link of claim 2, wherein:

a) the first end plate is connected to the distal ends of the first plurality of spacers by a plurality of fasteners; and b) the second end plate is connected to the distal ends of the second plurality of spacers by a plurality of fasteners.

* * * * *